US007854639B1

(12) United States Patent
Leal et al.

(10) Patent No.: US 7,854,639 B1
(45) Date of Patent: Dec. 21, 2010

(54) FLOTATION ASSEMBLY WITH MONITORING DEVICE

(76) Inventors: Eloy Leal, 5502 NW. 37 th Ave., Miami, FL (US) 33142; Ronald D. Stewart, 1050 Satin Leaf St., Hollywood, FL (US) 33019

( * ) Notice: Subject to any disclaimer, the term of this patent is extended or adjusted under 35 U.S.C. 154(b) by 259 days.

(21) Appl. No.: 11/394,660

(22) Filed: Mar. 31, 2006
(Under 37 CFR 1.47)

(51) Int. Cl.
*B63C 9/08* (2006.01)

(52) U.S. Cl. ..... 441/106

(58) Field of Classification Search ..... 441/89, 441/106

See application file for complete search history.

(56) References Cited

U.S. PATENT DOCUMENTS 5,448,110 A * 9/1995 Tuttle et al. ..... 257/723
6,439,941 B2 * 8/2002 McClure et al. ..... 441/89
6,545,606 B2 * 4/2003 Piri et al. ..... 340/573.1
6,910,931 B1 * 6/2005 Nakase ..... 441/106

* cited by examiner

*Primary Examiner*—Daniel V Venne
(74) *Attorney, Agent, or Firm*—Malloy & Malloy, P.A.

(57) ABSTRACT

A flotation assembly preferably, but not necessarily, of the type installed beneath the seat of a commercial airline and comprising a base structured and configured to define a life vest of the type intended to support an individual in a body of water. A monitoring device preferably comprises a radio frequency identification device or RFID tag, structured for wireless communication, is connected to the life vest in a predetermined location which generally restricts physical access thereto, but does not interfere with wireless communication therewith. As such, an appropriate reader assembly may be brought into the general vicinity of the RFID tags associated with a plurality of the life vests, thereby facilitating the efficient inspection of each of the life vests.

3 Claims, 4 Drawing Sheets

FLOTATION ASSEMBLY WITH MONITORING DEVICE

BACKGROUND OF THE INVENTION

1. Field of the Invention

The present invention is directed to a flotation assembly preferably, but not necessarily, in the form of a life vest of the type installed on commercial airlines. A radio frequency identification device (RFID) tag is connected to the life vest in a predetermined location which restricts physical access thereto but which allows wireless communication therewith. Informative data relating to the physical presence and maintenance condition of the life vest is stored on the RFID tags, thereby facilitating the inspection of the life vest by an appropriate reader assembly in an efficient manner.

2. Description of the Related Art

Federal regulations mandate that aircraft flying over water must be provided with an appropriate flotation assembly for each passenger. As such, flotation assemblies or life preservers are typically configured to be stored underneath each of the seats within the aircraft. In doing so, the life preservers are believed to be readily accessible by the passenger, in the event of an emergency. In an attempt to further facilitate ease of access and reduce costs, a number of attempts have been made to combine seat cushions and flotation assemblies for use on boats, as well as aircraft. It being contemplated that the material from which most seat cushions are made can also serve as a life preserver. However, in a majority of commercial airline applications the required flotation assemblies are normally provided in the form of inflatable life vests structured to be at least temporarily worn by an individual in an emergency situation. More specifically, the typical life vest available on commercial airlines as well as other commercial forms of transportation include inflatable structures which are provided with a gas supply in the form of a sealed gas cylinder which, when activated, provides sufficient gas to inflate the life vest in a quick and easy manner.

Further restrictions placed on commercial carriers include a requirement for periodic inspections of the life vests, at least to the extent of assuring that an adequate number of life preservers are present and properly stored in an intended an appropriate location for passenger access. In addition, other physical characteristics of the life preservers are periodically monitored. Such characteristics include age, required or intended service and/or maintenance records and other characteristics which may affect the overall performance of the life vest under emergency conditions. Moreover, in order to comply with the federally mandated inspection procedures, conventional practice typically involves the physical examination of each of the life preservers, which in turn requires direct access thereto. Further, a physical inspection of the life preservers may typically involve a visual examination and manual reading of appropriately listed, maintenance and related data printed or otherwise made visually accessible on some exposed portion of the life preserver. Clearly, such a manual inspection procedure of the type required to be provided on commercial carriers is time consuming, burdensome and expensive.

In order to overcome such disadvantages and problems there is a recognized need in the commercial travel industry, as well as a variety of other areas, for a monitoring system which meets federal or other regulatory guidelines for performing the required inspection of flotation assemblies, specifically, but not exclusively, of the type associated with commercial airlines and other commercial carriers.

In a related area, the monitoring of a variety of different articles, products, etc. through the use of radio frequency identification devices or "RFID tags" has been applied in a variety of different industries. Moreover, various attempts to modify and/or improve tracking and inventory control have been made in an attempt to adapt tagging systems for use in a variety of different applications. Such known applications include, but are not limited to, warehouses, retail outlets, industrial manufacturing sites and other typically industrial sites where a variety of articles or products are manufactured, transported, stored, sold, etc.

A common use of RFID tags comprises the tagging of articles associated with the display of pricing information in association with the shelving of various products, such as, in retail outlets. Pricing and inventory controls are sometimes maintained through the inclusion of coded data on the tags, such as by means of barcodes, which are determinative of the identity, price, etc. of the various products. Also, it is known that RFID tags are available which have sufficient memory capabilities to store various data relating to the product or object with which it is associated and which is to be monitored. Moreover, advancement in the monitoring industry has resulted in relatively sophisticated electronic tags which demonstrate greater versatility and efficiency in terms of tracking and inventory control of a large number of articles or products. As such, commercially available RFID tags are capable of retaining and transmitting a substantial amount of information, which may be required in different applications for the purpose of performing tracking and/or monitoring requirements which may be associated with modern day transportation facilities.

Therefore, commercially available technology associated with monitoring devices specifically, but not exclusively, in the form of RFID tags are capable of wireless communication. As such, appropriate monitoring devices may be adapted for use in the commercial transportation industry and would overcome many if not all of the disadvantages and problems associated with the physical inspection of flotation assemblies of the type required to be used on commercial carriers. Further, the utilization of monitoring systems and/or devices of the type set forth herein, in combination with any of a large number of differently structured flotation assemblies, would meet regulatory requirements for inspection of flotation assemblies specifically, but not exclusively, of the type mandated for use on commercial aircraft and other commercial carriers.

The present invention is directed to a flotation assembly primarily, but not exclusively, of the type used on commercial carriers, such as commercial airlines. As is well known, federal regulations mandate if aircraft flying over water be provided with a life preserver for each passenger. As conventionally stored, such life preservers or flotation assemblies are placed underneath the seat of each passenger or otherwise in a closed proximity thereto.

Accordingly, each life preserver is readily accessible to a correspondingly position passenger in the event of an emergency. In order to assure that each passenger of a commercial airline or other carrier is provided with an operable life preserver, regulatory requirement further mandate that each life preserver be periodically inspected to determine the presence as well as the physical condition thereof. Conventionally, such inspection requirement call for a physical location and at least visual inspection of the registered, informational data maintained on a "data panel" or other indicia verifying structure which recorded the age, maintenance record and other required physical characteristics of an individual life preserver. As should be readily apparent such physical inspection of an exceedingly large number of life preservers is both time consuming, labor intensive, expensive and unfortunately less than completely reliable.

SUMMARY OF THE INVENTION

Accordingly, the present invention is directed to a flotation assembly incorporating a monitoring device which alleviates the necessity for the physical or manual inspection thereof. In at least one preferred embodiment, the monitoring device is structured to accomplish wireless communication with an appropriate reader assembly or system. As such, the monitoring device may preferably comprise a radio frequency identification device or "RFID tag" structured, upon activation, to transmit pertinent data relating to the presence, location and other physical characteristics of the flotation assembly, to the aforementioned reader assembly or system.

Therefore, a preferred monitoring device, such as an RFID tag, is further structured to include sufficient memory capabilities to store pertinent data relating to the physical condition of the flotation assembly with which it is associated. Similarly, the data being transmitted from the RFID tag to the reader assembly may vary but preferably includes information relating to its presence in an intended location relative to the seat or other area associated with a passenger, pertinent maintenance and/or repair information, age and/or date of its original installation and other information relating to its reliability in case of use and/or activation during an emergency condition. As will be explained in greater detail hereinafter, additional structural and operative features of the monitoring device may include tracking capabilities which may expedite locating individuals in an emergency situation, utilizing appropriate facilities such as, but not limited to, GPS systems.

Therefore, the presence of a monitoring device on or within each of the flotation assemblies required to be placed on commercial carriers overcomes many of the disadvantages and problems associated with conventional inspection procedures of such flotation devices as required by governmental authorities. More specifically, instead of one or more individuals physically examining each flotation assembly, an appropriate reader assembly and/or associated operative system may be utilized to remotely "read" information or data stored on the monitoring devices associated with the plurality of flotation assemblies. As set forth above, the stored information may include the physical characteristics of individual ones of the flotation assemblies as well as the physical presence thereof in an intended location on a given aircraft, marine craft or other type carrier. Further, the transmitted information from each of the flotation assemblies can be recorded, stored or otherwise saved to provide a clear indication that all of the flotation assemblies are appropriately positioned and physically operative for use in the event of an emergency. Moreover, the recording of such data can be maintained so as to offer proof of compliance with the necessary inspection procedures as required under governmental regulations.

Additional operative and structural features of the various embodiments of the present invention include the disposition of the monitoring device in a predetermined location on the flotation assembly. The predetermined location of a monitoring device should be disposed and structured to restrict physical access to the monitoring device. The RFID tag or other monitoring device is thereby restricted from unauthorized or inadvertent removal from the flotation assembly. Moreover, in the event that the entire flotation assembly is removed from its intended, stored location relative to the passenger area, such absence would be readily detected by the aforementioned reader assembly attempting to establish wireless communication therewith. Further, the aforementioned "predetermined location" is not limited to one specific location on the flotation assembly. To the contrary, the predetermined location may vary dependent upon such factors as style and overall structure of the flotation assembly, as well as the intended inspection procedure and/or reader assembly utilized to conduct the required inspections.

Other features associated with the flotation assembly of the present invention may include the structuring of the monitoring device to establish a one-way or alternatively a two-way communication. The advantage of a monitoring device having two-way communication capabilities includes the ability to "program" or "reprogram" the monitoring device so as to update data stored therein. As such, the updated data can include the frequency and/or latest date of inspection as well as other pertinent information which may be required to comply with the regulatory standards.

Therefore, the flotation assembly of the present invention comprises a monitoring device incorporated therein which is capable of one-way or two-way wireless communication. As such, it overcomes many of the disadvantages and problems associated with conventional or known inspection procedures of flotation assemblies used in commercial airlines or other commercial carriers.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
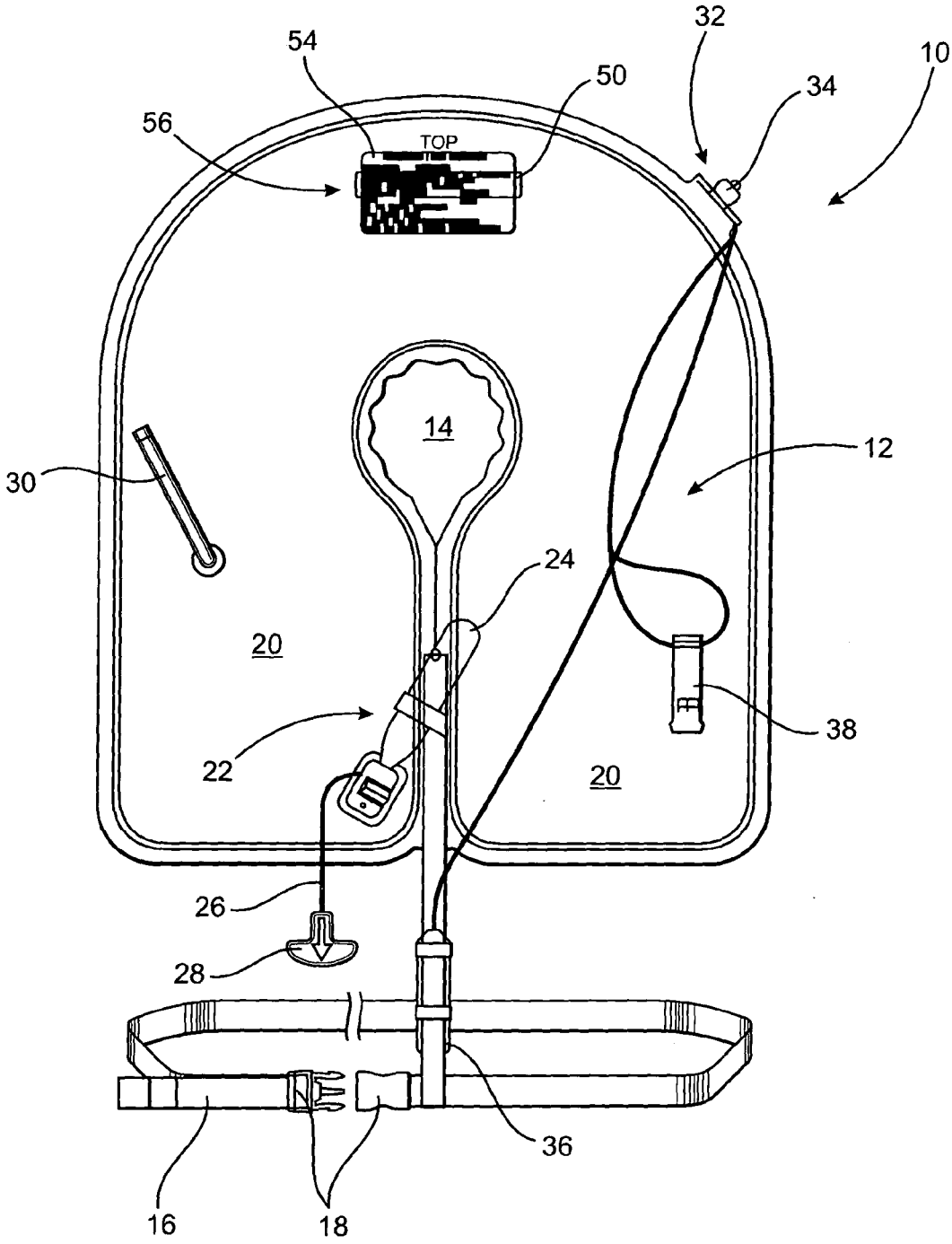
FIG. 1 is a front view of one preferred embodiment of a flotation assembly of the present invention with a monitoring device disposed thereon in a predetermined location.

As shown in the accompanying Figures, the present invention is directed to a flotation assembly generally indicated as 10 and 10'. As will be explained in greater detail hereinafter, the present invention is not intended to be limited to a specifically structured flotation assembly 10 or 10'. To the contrary, the present invention, including its various preferred embodiments, may be incorporated on or within a flotation assembly of any of a large number of types, styles and structures. Moreover, as specifically applied, one preferred embodiment of the present invention comprises the flotation assembly 10 or 10' being of the type which meets governmental regulatory standards for use in commercial airlines or other commercial carriers. However, the various structural and operative features of the present invention are not intended to be limited to one or more specific types of flotation assemblies 10 or 10' of the type disclosed in FIGS. 1 through 4.

Accordingly, the flotation assembly 10 or 10' includes a base 12 preferably, but not necessarily, structured, dimensioned and configured to be connected to an individual. In the preferred embodiments of FIGS. 1 through 4 the base 12 is configured in the form of a "life vest" type of flotation assembly. As such, the base 12 is designed to be at least temporarily mounted or secured about the neck and/or shoulders of the individual through the provision of an aperture or opening 14. In order to accomplish secure but removable attachment of the base 12 to an individual, the flotation assembly 10, 10' further includes a belt or like harness 16 disposed and structured to fit generally about the waist of an individual. The harness 16 has its free ends detachably connected to one another by a buckle assembly 18. Further, each of the flotation assemblies includes a buoyancy assembly which, when activated, serves to support the individual wearing the base or like vest 12 in an appropriate orientation on or within a body of water.

Figure 2:
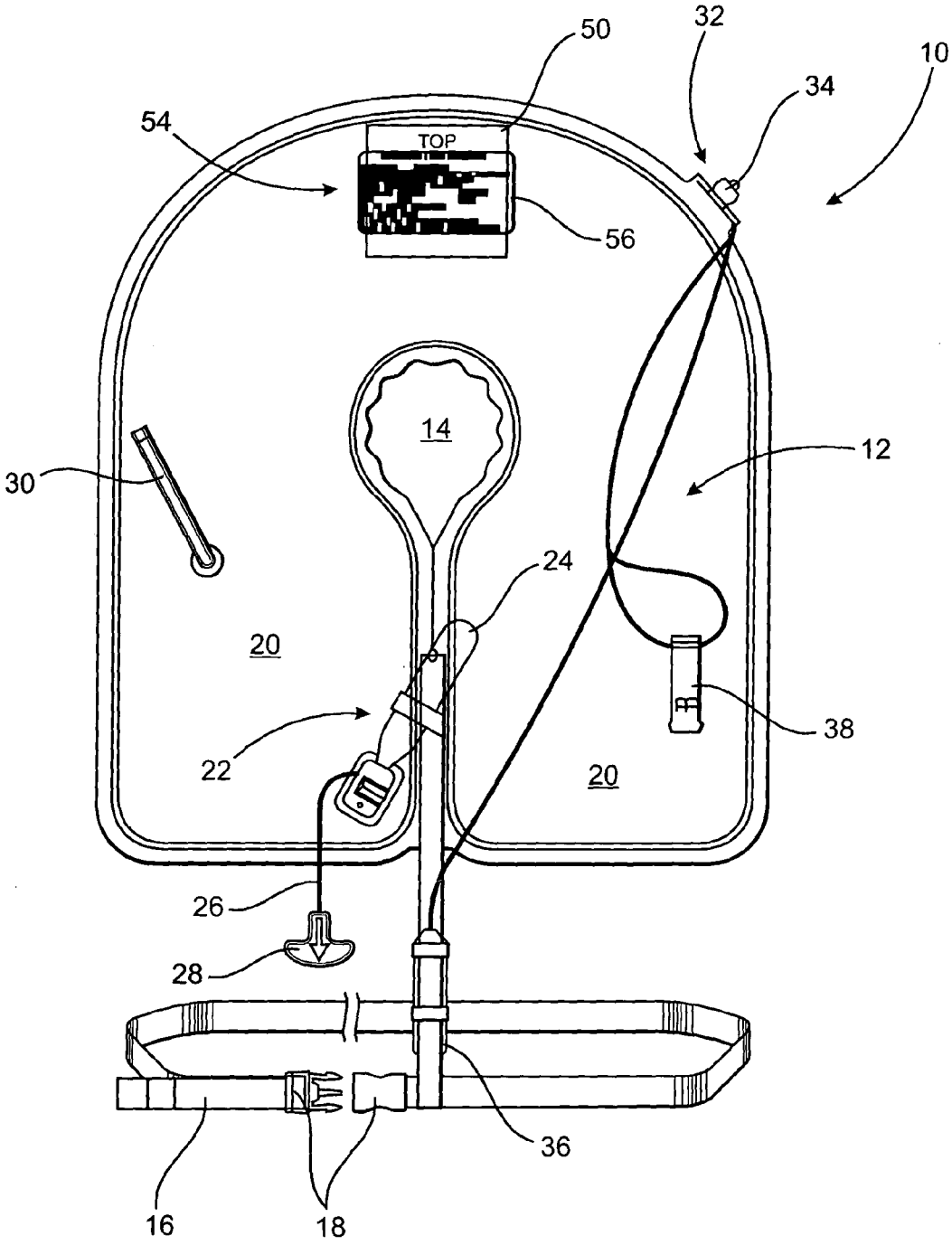
FIG. 2 is a front plan view of the embodiment of the flotation assembly as in FIG. 1 with a different monitoring device disposed thereon in a predetermined location.

With primary reference to FIGS. 1 and 2, the buoyancy assembly of the flotation assembly 10 comprises a single inflatable cell 20 disposed in surrounding relation to the neck or head aperture 14. The life vest base 12 further comprises an inflation assembly, generally indicated as 22, which includes a canister 24 of compressed gas which is released into the interior of the single cell 20 by manual activation of the pull cord 26 having an appropriate handle or other gripping member 28 secured thereto. As an auxiliary inflation assembly, the base 12 is also supplied with a blow tube 30 which communicates with the interior of the single inflatable cell 20 and which is structured and disposed to allow of a cell 20 to be manually inflated by an individual blowing into the tube 30.

Yet additional structural and operative features associated with the flotation assembly 10 include at least a first signaling device generally indicated as 32 in the form of a signal light 34 powered by a battery assembly 36 attached to the flotation assembly in any convenient location. An auxiliary or complementary signaling device, generally indicated as 38, comprises a whistle or like structure capable of generating an audible sound, such that an individual may further call attention to his or her location, if necessary.

Figure 4:
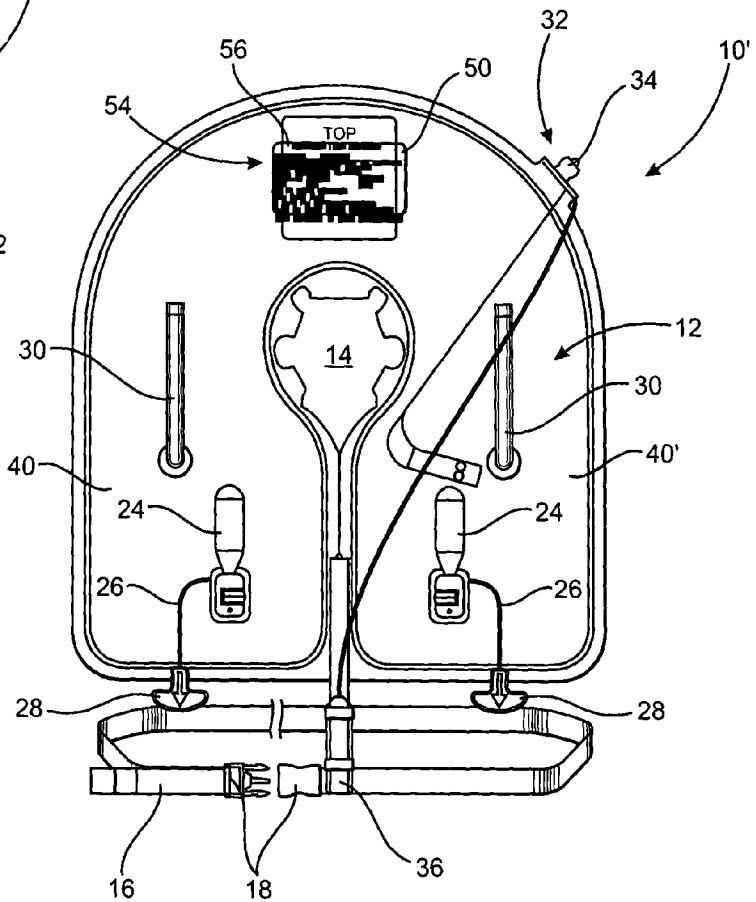
FIG. 4 is a front view of a flotation assembly similar to the embodiment of FIG. 3, wherein a different preferred embodiment of a monitoring device is disposed in a predetermined location.
Figure 3:
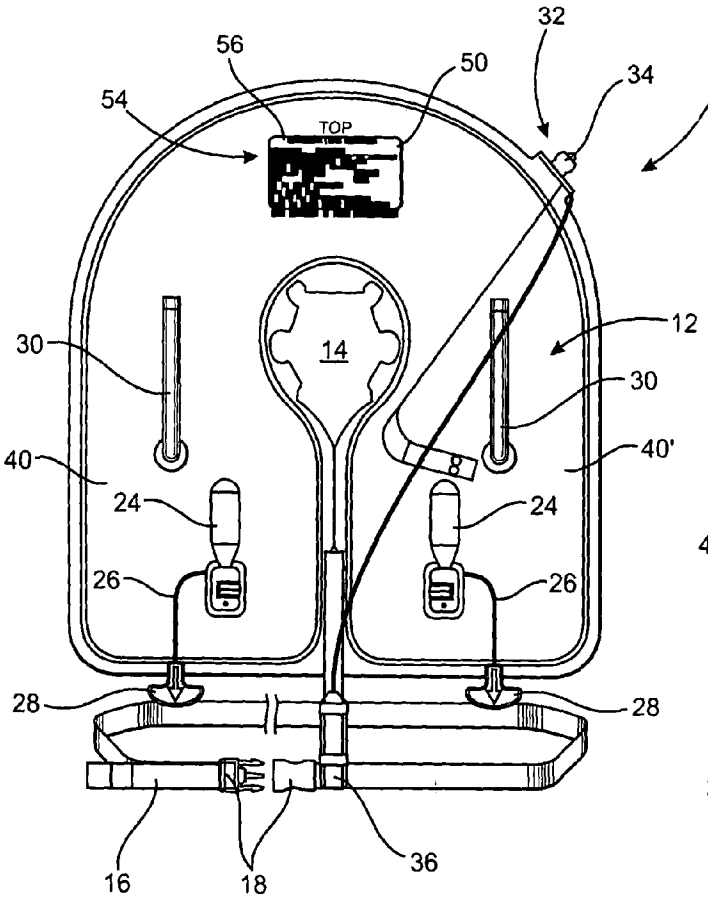
FIG. 3 is front view of yet another preferred embodiment of a flotation assembly with a monitoring device disposed thereon in a predetermined location.

With primary reference to the additional preferred embodiments of FIGS. 3 and 4, the flotation assembly 10' may include many of the structural and operative features of the flotation assembly 10 of the embodiment of FIGS. 1 and 2. By way of example, the flotation assembly 10' includes the base 12 having a buoyancy assembly defined by two inflatable cells 40 and 40' each including a separate compressed gas canister 24 having an activating pull cord/handle 26, 28 associated therewith. As such, the interior of the cells 40 and 40' may be independently but simultaneously inflated to facilitate the supporting of an individual in an intended orientation on or within a body of water. Like reference numerals refer to like parts associated with the different flotation assemblies 10 and 10' in the FIGS. 1 through 4.

Common to each of the embodiments of FIGS. 1 through 4, as well as other preferred embodiments to be described herein, is the inclusion of a monitoring device generally indicated as 50. Monitoring device 50 is structured to establish wireless communication with a reader assembly or other appropriate reader system (not shown for purposes of clarity) at least to the extent of generating a communication signal from the monitoring device 50 to a reader assembly. Such wireless communication may be representative of informational data relating to the existence or presence of the flotation assembly in its intended location. In addition, the transmitted information or data may include any of a variety of physical characteristics relating to the condition and operational reliability of the flotation assembly so as to assure it functioning as intended in the event of an emergency. Accordingly, the monitoring device 50 also includes memory capabilities structured to store the required physical and operational data which may be required for periodic inspection as mandated by governing regulatory authority.

Figure 5:
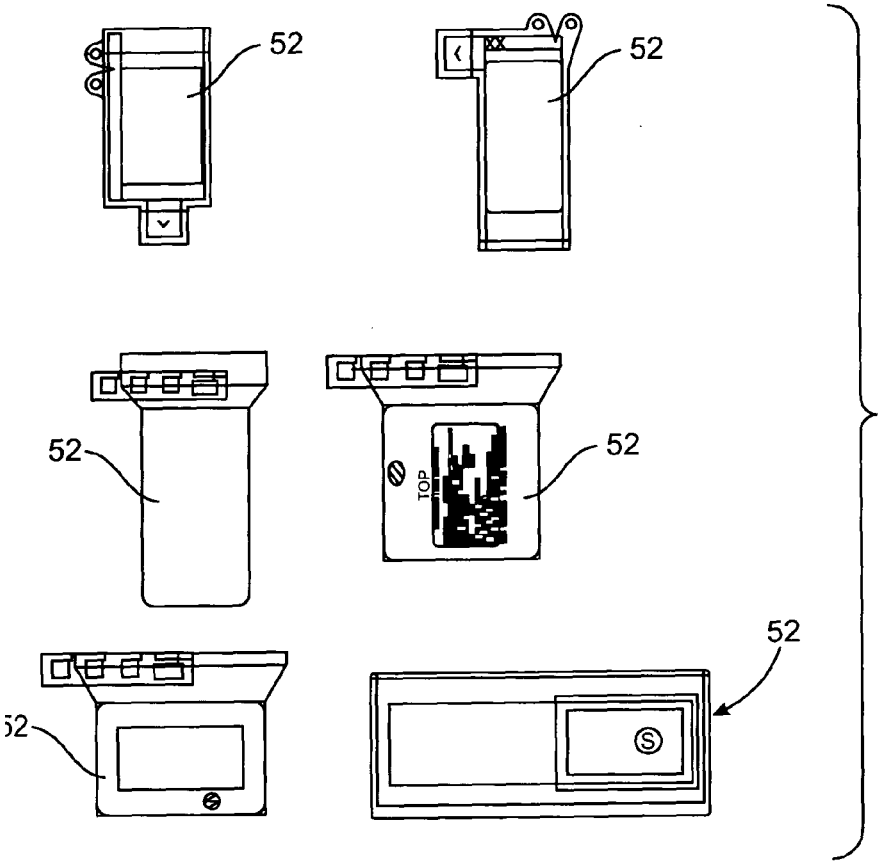
FIG. 5 is a composite view of different monitoring devices and/or structures associated with the predetermined locations at which they are mounted on the various types of flotation assemblies as represented in FIGS. 1 through 4.

With primary reference to FIG. 5, the monitoring device may comprise a plurality of different structures. In a most preferred embodiment, the monitoring device 50 comprises a radio frequency identification device or RFID tag 52 capable of operating at multiple frequencies including low, high or ultra high frequencies. Also, the tags 52 may be passive or active in terms of having a self contained power supply. For purposes of clarity a plurality of possible RFID tag structures are indicated as 52 and collectively disclosed in the indicated composite view. Another feature of the various embodiments of the present invention includes the monitoring device 50 and/or RFID tag 52 being disposed on or within the flotation assembly 10 or 10' at a "predetermined location". Such a predetermined location may vary depending upon the style, model, structure, dimension, configuration and/or manner of production of the flotation assembly 10 and/or base 12. However, common to each of the embodiments of the various flotation assemblies with which the monitoring device 50 and/or RFID tag 52 may be utilized is the structuring and disposition of the predetermined location being such as to prohibit or at least restrict physical access to the monitoring tag 50,52. The inability to easily maintain physical access to the monitoring device 50 prohibits or otherwise limits the ability to have the monitoring device 50 and/or RFID tag 52 being removed inadvertently by unauthorized personnel.

In a most preferred embodiment of the present invention and as demonstrated in the embodiments of FIGS. 1 through 4, the monitoring device 50, in the form of the RFID tag 52, is disposed in a predetermined location generally indicated as 54 adjacent to or otherwise associated with a "data panel" 56 connected to or otherwise structured to be a part of the flotation assembly 10 or 10'. The data panel 56 is a common structure frequently silk screened or otherwise fixedly associated with flotation assemblies 10 or 10' of the type accepted for use on commercial carriers. As such, the data panel 56 may include various types of informational data relating to the flotation assembly 10 or 10', its use, operation, maintenance, repair, etc. However, as conventionally disposed and structured the data panel 56 is mounted on a portion of the base 12 which is normally exposed on a continuous basis. This normal exposure is to facilitate physical or visual access to the data panel 56.

Further, the data panel 56 is located on an exposed area of the base 12 which is normally not folded or otherwise distorted. As such, damage to the data panel 56 and accordingly the monitoring device 50 and RFID tag 52 disposed at the adjacent predetermined location 54 is minimized or significantly restricted. Accordingly, in the embodiments of FIGS. 1 through 4, the predetermined location 54 of the monitoring device 50 and/or RFID tag 52 is behind or otherwise substantially adjacent to the data panel 56 and may be further located at least partially on the interior of the base 12. As such, the predetermined location 54 of the monitoring device 50 is such as to be effectively covered, surrounded or otherwise "shielded" by the data panel 56 thereby restricting physical access thereto.

Figure 6:
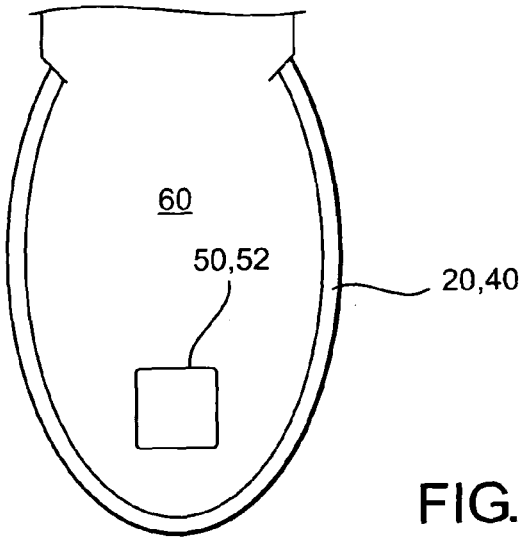
FIG. 6 is a sectional, interior view in partial cutaway and schematic form of yet another preferred embodiment of the present invention comprising the monitoring device being located in a predetermined location differing from that disclosed in FIGS. 1 through 4.

With primary reference to FIG. 6, other predetermined locations of the monitoring device 50 and/or RFID tag 52 may comprise the interior 60 of one or more of the inflatable cells 20, 40 and/or 40'. As such, the monitoring device 50 and/or tag 52 may be fixed on the inflatable interior 60 of the cell 20, 40 or 40' or may be loosely disposed therein without being directly connected or attached thereto. In any event, the aforementioned predetermined location of the monitoring device 50, which may be defined by an RFID tag 52, is such as to restrict the physical access to the monitoring device 50 so as to prevent inadvertent or unauthorized removal thereof from the flotation assembly 10 or 10'.

Accordingly the flotation assembly 10 and 10' and associated monitoring device 50 of the present invention, as described with regard to one or more preferred embodiments thereof, overcomes many, if not all, of the existing disadvantages and problems associated with conventional inspection procedures for flotation assemblies of the type used on commercial airlines or other commercial carriers.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A method of inspecting a flotation assembly for compliance with predetermined inspection requirements, the flotation assembly comprising a base dimensioned and configured to removably engage an individual, the method comprising:

disposing a monitoring device on the base at a predetermined location to which physical access is restricted, the monitoring device comprising a radio frequency identification (RFID) tag assembly, storing operational data on the RFID tag assembly, the operational data comprising data at least relating to a physical condition of the floatation assembly determinative of compliance with the predetermined inspection requirements for the floatation assembly, and prior to operative use of the flotation assembly, periodically generating a wireless signaled communication with the RFID tag assembly disposed on the base of the floatation device to access and read the operational data stored thereon.

2. The method as recited in claim 1 further comprising defining the operational data as comprising information determinative of a presence of the floatation assembly in an intended stored location prior to use by an individual.

3. The method as recited in claim 1 further comprising recording the operational data accessed from the RFID tag assembly as proof of compliance with predetermined mandated inspection procedures.

* * * * *